US008990997B2

(12) United States Patent
Scholze

(10) Patent No.: US 8,990,997 B2
(45) Date of Patent: Mar. 31, 2015

(54) TOOTHBRUSH

(71) Applicant: Jurgen Scholze, Leichlingen (DE)

(72) Inventor: Jurgen Scholze, Leichlingen (DE)

(73) Assignee: Scapa Holding GmbH, Eschborn (DE)

( * ) Notice: Subject to any disclaimer, the term of this patent is extended or adjusted under 35 U.S.C. 154(b) by 0 days.

(21) Appl. No.: 13/772,534

(22) Filed: Feb. 21, 2013

(65) Prior Publication Data

US 2013/0227806 A1 Sep. 5, 2013

(30) Foreign Application Priority Data

Feb. 22, 2012 (DE) ..... 20 2012 100 595 U

(51) Int. Cl.
*A46B 9/04* (2006.01)
*A46B 5/00* (2006.01)

(52) U.S. Cl.
CPC . *A46B 9/04* (2013.01); *A46B 5/007* (2013.01); *A46B 2200/1066* (2013.01)
USPC ..... 15/167.1; 15/144.1

(58) Field of Classification Search
CPC ... A46B 9/04; A46B 5/007; A46B 2200/1066
USPC ..... 15/144.1, 172, 167.1
See application file for complete search history.

(56) References Cited

U.S. PATENT DOCUMENTS 4,654,922 A * 4/1987 Chen ..... 15/172
5,146,645 A 9/1992 Dirksing
6,003,189 A * 12/1999 Falleiros ..... 15/167.1

FOREIGN PATENT DOCUMENTS

DE 29913656 11/1999
DE 102005008199 2/2005
DE 60011766 7/2005
DE 202011000912 8/2011
DE 202011000912 U1 * 9/2011

* cited by examiner

*Primary Examiner* — Shay Karls
(74) *Attorney, Agent, or Firm* — McCormick, Paulding & Huber LLP

(57) ABSTRACT

In order to create a toothbrush having a head part with bristles and having a handle part, such that the head part is movably connected to the handle part by means of a spring-like device and such that the device comprises a web which extends through the device and with which the head part is connected to the handle part in one piece, the head part being connected to the handle part by a spring-like device, such that the head part executes an approximately parallel displacement under load. The proposed device has an elastic supporting element with an opening, and the supporting element comprises a supporting web which borders the opening and together with the web, when a load is applied to the head part, produces an approximately parallel displacement of the head part from an initial position into at least one load position together with the web.

10 Claims, 2 Drawing Sheets

TOOTHBRUSH

CROSS-REFERENCE TO RELATED APPLICATION

This application claims the benefit of German Patent Application Serial No. 20 2012 100 595.6, filed Feb. 22, 2012, entitled "TOOTHBRUSH", herein incorporated by reference in its entirety.

DESCRIPTION

The present invention relates to a toothbrush having a head part with bristles and having a handle part, such that the head part is movably connected to the handle part by means of a spring-like device and such that the device comprises a web which extends through the device and with which the head part is connected to the handle part in one piece.

PRIOR ART

DE 20 2011 000 912 U1 describes a generic toothbrush having a head with bristles and having a handle part, the head part being movably connected to the handle part by means of a spring-like device. A web extends over the device between the head part and the handle part, such that the handle part is connected in one piece to the head part. If a load is applied to the head part of the toothbrush by using it and by a compressive force acting on the bristles disposed on the head part, the elastic spring-like device causes a tilting or a pivoting of the head part in relation to the handle part. If the toothbrush is used by holding the handle part in one hand and by guiding the head part over a row of teeth, the tilting of the head part causes the bristles to be positioned incorrectly with respect to the teeth. This incorrect position occurs due to the tilting and the bristles can no longer come in complete contact with the teeth.

U.S. Pat. No. 6,003,189 A1 describes a toothbrush which solves the problem of improper positioning of the head part with respect to the teeth by providing a parallelogram device between the head part and the handle part. The parallelogram device comprises two beams, which are designed to be identical to one another and are guided in parallel, separated from one another by a longitudinal slot. Absorber bodies by means of which the spring hardness of the head part is adjusted with respect to the handle part are inserted into the longitudinal slot. This yields a complicated design of the spring-like device and results in a negative effect on the ease of handling of the toothbrush due to the longitudinal beams between the head part and the handle part. Furthermore, the absorber body can become loosened between the beams, which is a disadvantage.

PRESENTATION OF THE INVENTION: PROBLEM, SOLUTION, ADVANTAGES

The problem on which the present invention is based is therefore to create a toothbrush having a head part, which is connected to the handle part via a spring-like device, such that the head part executes an approximately parallel displacement under load, such that the spring-like device has the simplest possible design and the toothbrush is advantageously easy to handle.

This problem is solved starting from a toothbrush having a head part with bristles and having a handle part, such that the head part is movably connected to the handle part by means of a spring-like device and such that the device comprises a web which extends through the device and with which the head part is connected to the handle part in one piece, in combination with the characterizing features hereinafter described. Advantageous further embodiments of the invention are described in the dependent claims.

The present invention includes the technical teaching that the device has an elastic supporting element with an opening and the supporting element comprises a supporting web which borders the opening and which, together with the web, creates an approximately parallel displacement of the head part from an initial position into at least one load position when a load is applied to the head part.

The present invention thus proposes an elastic supporting element which is preferably arranged on the web, such that the arrangement of the elastic supporting element may be accomplished in a wide variety of ways. The material of the elastic supporting element differs from the material of the head part and that of the handle part as well as the web because the head part, the handle part and the web are all made of the same first material and the supporting element is made of a second material, which is different from the first material.

The device according to the present invention comprises the web extending between the head part and the handle part as a first connection between the head part and the handle part, and another connection between the head part and the handle part is formed by the supporting web in the elastic supporting element. Between the web of the toothbrush and the supporting web there is an opening in the elastic supporting element which may be designed as a lateral passage, for example.

A degenerate parallelogram is created by the spring-like device between the head part and the handle part, and the supporting web need not run exactly in parallel with the web between the handle part and the head part. Instead the opening may have an elliptical contour, which may be bordered by the web on a first side and may be bordered by the supporting web on a second side opposite the first side. If the head part of the toothbrush is put under a load, the supporting web may be deformed in a curved shape and/or the supporting web may form a kink area. A kink area is formed in the supporting web when it buckles, such that the opening between the supporting web and the web undergoes deformation, in particular becoming larger. Pivoting of the head part under load with respect to the handle part is superimposed on an approximately parallel displacement due to the supporting web and its corresponding deformation behaviour, and in particular the pivoting movement of the head part may be converted to a parallel displacement. A force is built up between the handle part and the head part via the supporting web, reshaping the web between the head part and the handle part, so that the head part is shifted approximately in parallel when a load is applied to the bristles and consequently no longer tilts exclusively with respect to the handle part.

The opening may have an elliptical shape, comprising in particular a main axis H and a secondary axis N, such that the length ratio between the main axis H and the secondary axis N changes under a load on the head part. In particular the elliptical shape of the opening may be designed so that the length ratio of the main axis to the secondary axis becomes smaller under a load on the head part. The decreasing ratio of the main axis to the secondary axis is due in particular to the fact that the supporting web can buckle outward in its kink area, such that the secondary axis becomes larger while the main axis remains essentially the same. Buckling of the supporting web in the kink area may in particular be superimposed on a curved shape of the supporting web.

The handle part may be designed to be elongated and extend in a handle axis, and the head part may extend at least partially in a head part axis, such that the handle part axis and the head part axis run approximately parallel to one another with an offset. The offset between the handle part axis and the head part axis is formed by the spring-like device, and the head part is in a position which is set back with respect to the handle part, such that the handle part axis runs on the side of the bristles on the head part. If a load is applied to the head part via the bristles, then the distance between the handle part axis and the head part axis increases as a result.

The spring-like device may be designed with the elastic supporting element between the head part and the handle part, such that the main axis of the elliptical opening extends obliquely between the handle part axis and the head part axis. Consequently, at least one section of the web and one section of the supporting web extend obliquely between the handle part axis and the head part axis, in particular when the head part is not under a load. If a load is applied to the head part and if the displacement between the handle part axis and the head part axis increases, then the increasing inclination of the supporting web in relation to the head part axis and to the handle part axis may be greater than the increasing inclination of the web between the head part axis and the handle part axis. Consequently, the approximately parallel displacement of the head part from the starting position into the load position takes place with a change in the shape of the elliptical opening in the elastic supporting element.

According to a preferred embodiment, to form the device, the elastic supporting element may be integrally moulded on the web of the toothbrush between the handle part and the head part by an injection moulding step. Alternatively, the elastic supporting element may also be glued or clipped onto the web. Then the web may be at least partially surrounded by the material of the supporting element, or the web may be completely surrounded by the material of the supporting element. Consequently, the degenerate parallelogram is formed by the web and the supporting web, such that the supporting web is formed completely from the material of the supporting element, and the web may be formed from the material of the head part and/or of the handle part and additionally proportionally from the material of the supporting element. The material of the supporting element may have a lower hardness than the material of the web and is preferably more elastic; in particular the supporting element may be made of a rubber material or a rubber-like material.

According to another advantageous embodiment, the supporting element may extend with a partial section into and along the head part. The partial section may be arranged on the rear side of the head part, which is designed opposite the site of the bristles on the head part. The supporting web of the elastic supporting element advantageously develops into the partial section of the supporting element on the head part, and when a load is applied to the head part and the head part is transferred from the starting position into the load position, the supporting web can be supported on the partial section of the supporting element in such a way that there is parallel guidance of the head part in relation to the handle part.

BRIEF DESCRIPTION OF THE DRAWINGS

Additional measures that improve the invention are described in greater detail below together with the description of a preferred exemplary embodiment of the invention with reference to the figures, in which.

PREFERRED EMBODIMENTS OF THE INVENTION

Figure 1:
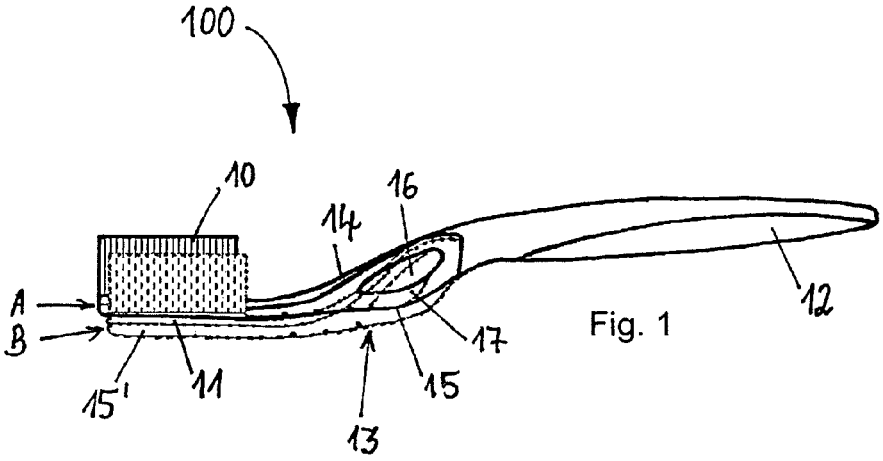
FIG. 1 shows an embodiment of a toothbrush having the features of the present invention.

FIG. 1 shows a toothbrush 100 having a head part 11 with bristles 10 and having a handle part 12, such that the head part 11 is movably connected to the handle part 12 by means of a spring-like device 13. The mobility of the head part 11 is indicated by two positions of the head part 11. The head part 11 is in a first starting position A when it is not under a load and the head part 11 is in the load position B when a force is being exerted on the bristles 10, such that the head part 11 is in the load position B shown with dashed lines.

The spring-like device 13 comprises a web 14, which extends through the device 13, such that the head part 11 is connected in one piece to the handle part 12 via the web 14 and is made of the same material. This yields the advantage that the head part 11, the handle part 12 and the web 14 can be produced as a component in a single injection moulding step. At the same time, the web 14 forms a first part of the spring-like device 13, and the spring-like device 13 also comprises an elastic supporting element 15 which is integrally moulded onto the web 14 with the head part 11 and the handle part 12 in an additional injection moulding step. The elastic supporting element 15 is made of a material that is softer than the material of the web 14 and of the head part 11 and/or the handle part 12 and which thus has a higher elasticity. The spring-like device 21 thus comprises the web 14 on the one hand and the elastic supporting element 15 on the other hand.

The elastic supporting element 15 has an opening 16, which forms a passage like an eye through the elastic supporting element 15. This passage extends across the longitudinal direction of the toothbrush 100 and may be introduced approximately centrally in the elastic supporting element 15. The exemplary embodiment of the opening 16 has an elliptical shape, and the opening 16 is bordered on a first side by a partial area of the material of the supporting element 15 and by the web 14, and on an opposite side, the opening 16 is bordered by a supporting web 17 of the elastic supporting element 15. The elastic supporting element 15 additionally comprises a partial section 15' which extends into the area of the head part 11 along the latter.

Figure 2:
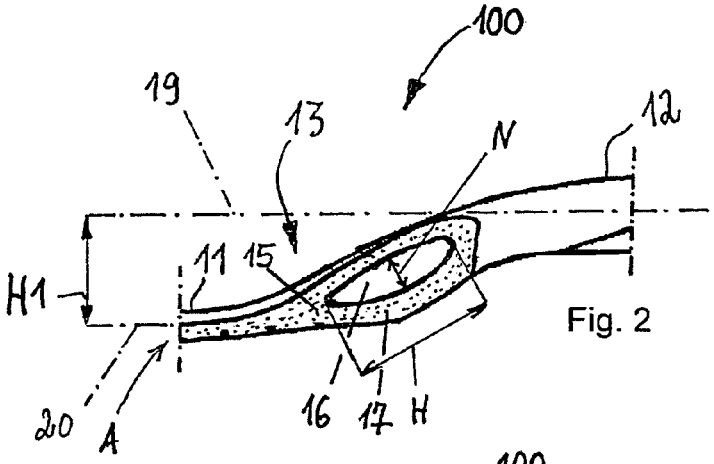
FIG. 2 shows a detailed view of the spring-like device of the toothbrush, such that the head part is in an unloaded state.
Figure 3:
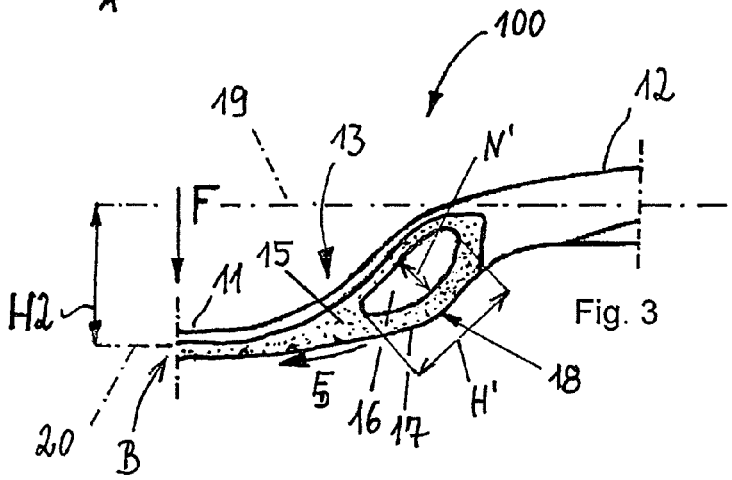
FIG. 3 shows a detailed view of the spring-like device of the toothbrush, such that the head part is in a loaded state.

FIGS. 2 and 3 shows the toothbrush 100 in the area of the spring-like device 13 with which the head part 11 is connected to the handle part 12. FIG. 2 shows the toothbrush 100 in an unloaded state, and FIG. 3 shows the toothbrush 100 in a state in which it is loaded with the force F, so that the force F acts on the head part 11 from the direction of the bristles 10 and reflects the force that can act on the bristles from the teeth.

The handle part 12 extends in a handle part axis 19 and the head part 11 extends in a head part axis 20. It can be seen by comparing FIGS. 2 and 3 that the height H1 of the handle part axis 19 above the head part axis 20 in the unloaded state (FIG. 2) is smaller than the height H2 of the handle part axis 19 above the head part axis 20 in the unloaded state (FIG. 3). In the unloaded state, the head part 11 is in the starting position A, and in the loaded state, the head part 11 is in the load position B as shown. It can be seen by the comparison that the head part axis 20 runs approximately parallel to the handle part axis 19 despite a load on the head part 11 by the force F, so that the head part 11 is displaced from the starting position A into the load position B approximately in parallel. This effect is made possible by the special design of the elastic supporting element 15 to form the spring-like device 13, as will be explained in greater detail below.

The spring-like device 13 has an opening 16 with a basic elliptical shape. The basic elliptical shape of the opening 16 has a longer main axis H and a shorter secondary axis N running perpendicular to the main axis H. The main axis H extends obliquely to the handle part axis 19 and to the head part axis 20 and the head part 11 is acted upon by the force F, such that the inclination of the main axis H to the handle part axis 19 and/or to the head part axis 20 increases slightly. At the same time, the geometry of the ellipse also increases and the main axis H' becomes slightly shorter, while the secondary axis N' becomes longer.

In addition, a kink area 18 in which the supporting web 17 is forced outward in a curve is formed in the supporting web 17. The increase in the secondary axis N' in the loaded state is induced in this way in particular.

The buckling in the supporting web 17 is caused by a compressive load in the supporting web 17, which is in turn caused by the force F, this compressive load being transferred and/or supported by the partial section 15' of the supporting element 15 which continues into the head part 11. The compressive load between the supporting web 17 and the partial section 15' of the supporting element 15 is indicated by a force arrow of a compressive force $F_D$ in the lower area of the supporting web 17.

A parallel displacement of the head part 11 from the starting position A into the load position B is caused by the resulting force ratios between the outer force F and the resulting internal compressive force $F_D$ on the supporting web 17. This yields an improved utilization of the bristles 10 in contact with a row of teeth, as illustrated in the following FIGS. 4 and 5 and explained in greater detail below.

Figure 4:
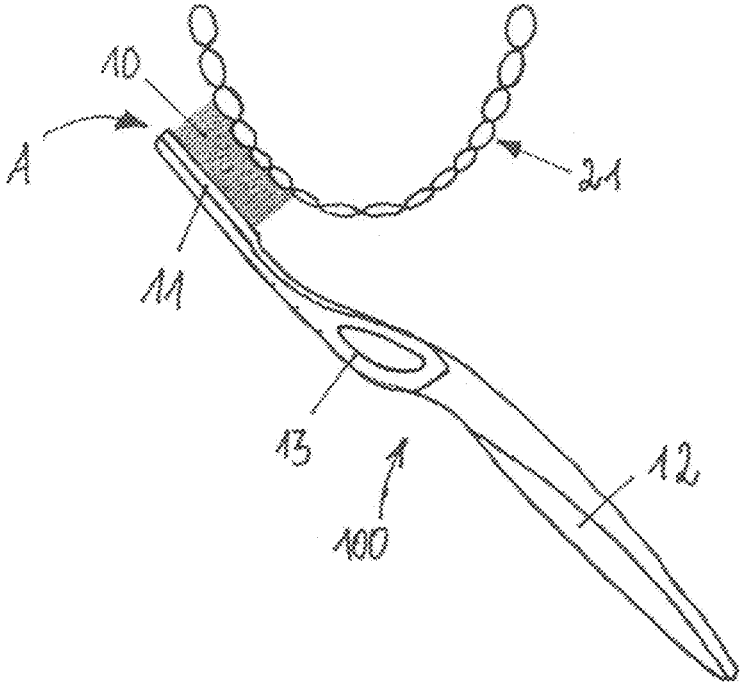
FIG. 4 shows a toothbrush engaged with a number of teeth in an unloaded state.
Figure 5:
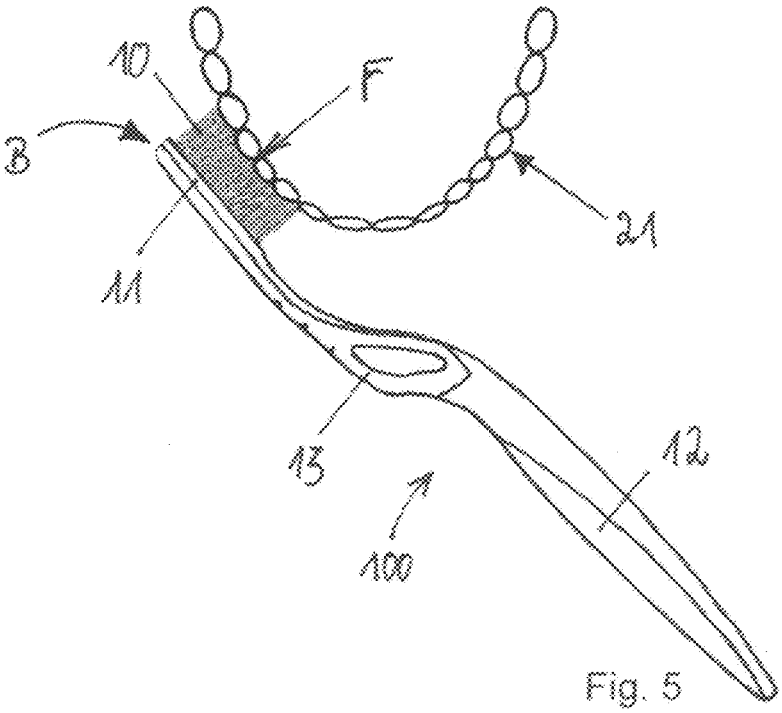
FIG. 5 shows a toothbrush in engagement with a row of teeth in a loaded state.

FIGS. 4 and 5 show a toothbrush 100 having the features of the present invention in contact with a row of teeth 21, for example, teeth of the lower jaw or of the upper jaw. FIG. 4 shows the use of the toothbrush 100 without a compressive load on the bristles 10, and FIG. 5 shows the use of the toothbrush 100 by applying a force F, and it can be seen that the spring-like device 13 is in the unloaded state in FIG. 4 and is in the loaded and spring-deflected state in FIG. 5.

Despite the spring deflection of the spring-like device 13, the bristles 10 are in contact with the row of teeth 21 over their entire length because only a parallel displacement of the head part 11 from its starting position A (FIG. 4) into its load position B (FIG. 5) is achieved by the spring action of the device 13. If the head part 11 were to be tilted with respect to the handle part 12 due to the spring-like device 13, then the front part of the bristles 10 would become disengaged from the row of teeth 21, which would result in an inferior use of the toothbrush 100. However, due to the special design of the spring-like device 13 according to the invention, the bristles 10 remain in contact with the row of teeth 21 over their entire length despite a load being applied to the head part 11 by the force F.

The invention is not limited in its embodiment to the only preferred exemplary embodiment described above. Instead, numerous variants which make use of the approach depicted here are also conceivable, even with fundamentally different types of embodiments. All the features and/or advantages, including structural details or spatial arrangements, which are derived from the claims, the description or the drawings may be essential to the invention either alone or in a wide variety of combinations.

What is claimed is:

1. A toothbrush, comprising:

a head part with bristles; and a handle part; and a spring-like device movably connecting the head part to the handle part, the spring-like device including a web which extends through the spring-like device and with which the head part is connected to the handle part in one piece, and an elastic supporting element having an opening;

wherein the elastic supporting element includes a supporting web bordering a first side of the opening opposite the web such that a thickness of the elastic supporting element opposite the web on the first side of the opening is greater than a thickness of the elastic supporting element on a second side of the opening adjacent to the web; and wherein the elastic supporting element, together with the web, produces an approximately parallel displacement of the head part from an initial position (A) into at least one load position (B) together with the web under load on the head part.

2. The toothbrush according to claim 1, characterized in that the supporting web is deformed in the shape of a curve with a load on the head part and/or forms a kink area.

3. The toothbrush according to claim 1, characterized in that the opening has an elliptical shape comprising in particular a main axis (H) and a secondary axis (N), such that the length ratio between the main axis (H) and the secondary axis (N) changes with a load on the head part.

4. The toothbrush according to claim 3, characterized in that the elliptical shape of the opening is designed, such that the length ratio of the main axis (H) to the secondary axis (N) becomes smaller with a load on the head part.

5. The toothbrush according to claim 1, characterized in that the handle part extends in a handle part axis and the head part extends in a head part axis, such that the handle part axis and the head part axis run approximately parallel to one another with an offset (H1), in particular so that the handle part axis extends on the side of the bristles.

6. The toothbrush according to claim 5, characterized in that the main axis (H) of the elliptical opening extends obliquely between the handle part axis and the head part axis.

7. The toothbrush according to claim 1, characterized in that the elastic supporting element is integrally moulded on the web in an injection moulding step.

8. The toothbrush according to claim 1, characterized in that the web is surrounded at least partially by the material of the supporting element.

9. The toothbrush according to claim 1, characterized in that the opening is completely bordered by the material of the supporting element, in particular such that the material of the supporting element has a lower hardness than the material of the web.

10. The toothbrush according to claim 1, characterized in that the supporting element extends with a partial section into the area of the head part.

* * * * *